United States Patent [19]

Sturm

[11] Patent Number: 5,007,503

[45] Date of Patent: Apr. 16, 1991

[54] LADDER LEVELLING DEVICE WITH LOCKING MEANS

[76] Inventor: Walter Sturm, 81 Benchlands Drive, Cochrane, Alberta, Canada, T0L 0W1

[21] Appl. No.: 554,430

[22] Filed: Jul. 19, 1990

[51] Int. Cl.[5] ..... E06C 7/44

[52] U.S. Cl. ..... 182/202; 248/188.3

[58] Field of Search ..... 182/202, 201, 200, 107, 182/111; 248/188.3

[56] References Cited

U.S. PATENT DOCUMENTS

| | | | |
|---|---|---|---|
| 2,552,941 | 4/1946 | Courtney | 182/202 |
| 2,598,875 | 4/1951 | Anderson | 182/202 |
| 3,090,466 | 5/1963 | Wright | 182/202 |
| 3,102,606 | 9/1963 | Hopfeld | 182/202 |
| 3,215,383 | 11/1965 | Wright | 248/188.3 |
| 3,794,141 | 2/1974 | Sturm | 182/202 |
| 3,880,388 | 4/1975 | Béguin | 182/202 |
| 4,095,671 | 6/1978 | Forristall | 182/202 |
| 4,497,390 | 2/1985 | Wilson | 182/202 |
| 4,770,275 | 9/1988 | Williams | 181/202 |

FOREIGN PATENT DOCUMENTS

| | | | |
|---|---|---|---|
| 992510 | 7/1976 | Canada | 182/202 |
| 183886 | 9/1963 | Sweden . | |

*Primary Examiner*—Reinaldo P. Machado
*Attorney, Agent, or Firm*—Michael Sand Co.

[57] ABSTRACT

An automatic levelling device for attachment to a ladder to allow the ladder to be used on an uneven supporting surface. The levelling device includes a downwardly opened U-shaped tubular member which guidably supports therein a ball chain connecting element. Slidable within the open ends of the tubular member and attached to opposite ends of the connecting element are extendable legs.

A locking means is connected to the tubular member and is adapted to cooperate with the ball chain to provide positive locking of the chain when the extendable legs are in the proper position to maintain the ladder in a vertical orientation. The ball chain when locked in the locking means can not be unlocked unless weight is removed from both supporting legs.

8 Claims, 5 Drawing Sheets

LADDER LEVELLING DEVICE WITH LOCKING MEANS

BACKGROUND OF THE INVENTION

This application relates to a device for adapting the length of a pair of legs to the unevenness of a supporting surface. More particularly, the invention relates to a device which may be part of a ladder or adapted to be attached thereto for the purpose of permitting safe use of the ladder on uneven ground.

In Applicant's prior U.S. Pat. No. 3,794,141, the disclosure of which is incorporated herein by reference, there is disclosed a device which may be attached to a ladder so as to adjust the length of a pair of legs to the unevenness of the ground surface. Applicant's prior patent discloses a downwardly facing substantially U-shaped member adapted to be attached to the legs of a ladder. Reciprocally extending leg members project upwardly into the U-shaped tubular member and each extendable leg is joined to a continuous ball chain member which is guidably supported within the tubular member. The ball chain member comprises a central flexible core on which are threaded a plurality of balls suitably arranged so that upward force on one of the extendable legs causes the other extendable leg to be forced downward. When equal, upward force is applied on both of the extendable legs, the extendable legs and hence the ladder to which the device is attached is maintained in that orientation.

Applicant's prior patent also discloses and claims locking means attached to the tubular member, the locking means having an integrally formed, arcuate chamber positioned above the tubular member and having downwardly projecting pins within the arcuate chamber. When equal upward force is applied to both extendable legs, the ball chain member is forced up into the arcuate chamber such that the downwardly projecting pins are seated or positioned between the balls to prevent further reciprocal movement of the ball chain connecting member.

Subsequent to issuance of Applicant's prior U.S. patent, other leg levelling devices have been disclosed. For example, Canadian Pat. No. 992,510 which issued July 6, 1976 to Beguin provides a leg type support with automatic adjustment and means to lock an interconnected supporting element in place.

U.S. Pat. No. 4,497,390 issued Feb. 5, 1985 to Wilson also discloses a self levelling device for a ladder comprising an interconnecting tubular member in which a plurality of balls are guidably retained. The balls in the Wilson patent are not connected and, hence, are subject to longitudinal displacement if, for example, uneven forces are applied on the legs of the ladder.

U.S. Pat. No. 4,770,275 which issued Sept. 13, 1988 to Williams also discloses a leveller for a ladder comprising a pair of sliding legs telescopingly engagable in upright tubes. A connecting element in the form of a continuous flexible ligament such as a wire rope acts on the slidable legs so that as one leg is shortened the opposite leg is lengthened until equal upward force is imposed on both legs.

The deficiency of the prior art including Applicant's own prior patent involves the lack of positive locking of the legs in the position in which they accommodate an uneven surface. In all of the prior art devices known to Applicant, equal upward force must be applied on both extendable legs in order for the legs to remain in the proper position.

Therefore, there is a requirement for a device which may be attached to a ladder which accommodates uneven supporting surface wherein the legs are positively locked in the selected position. For example, if a ladder is being used on an uneven surface and the ladder is resting against a smooth, shiny surface such as a wall having aluminum siding or an eavestrough, and the person using the ladder reaches outwardly to one side of the ladder unequal forces will be applied to the legs. If the person using the ladder reaches still further outwardly to one side, all of the weight will be borne by one of the legs and a situation may exist where the opposite leg will lift off of the supporting surface. In the devices of the prior art, when the weight is removed from the opposite leg, the interconnecting ball chain or equivalent connecting member will permit the leg which does not bear the weight to extend further out of the supporting tube which, of course, means that the leg which is bearing all of the weight will extend further upwardly into the supporting tube. This will further compound the unequal weight situation and the ladder will quickly tip sidewardly thereby placing the person using the ladder in great danger. If, for example, the ladder is being used on a scaffold far above the ground, the person using the ladder may well fall to their death as a result of the shifting load on the legs of the ladder.

SUMMARY OF THE INVENTION

The device, according to the present invention, therefore, represents an improvement over the prior art including Applicant's own prior patent whereby the interconnecting ball chain element is positively locked in a chamber such that the legs, once set, will not readjust unless weight is removed from both of the supporting legs.

Therefore, in accordance with the present invention, there is provided a device for adapting the length of a pair of legs to the unevenness of a surface, the device comprising a pair of vertically reciprocally extendable legs, each extendable leg guidably mounted in a tubular member attached to the pair of legs. The tubular member is in the shape of a downwardly open U. A longitudinally slidable chain like connecting element is accommodated within the tubular member and is connected at each end to one of the pairs of extendable legs. The connecting element comprises a flexible core having thereon a plurality of spheres wherein each of the spheres is separated by a spacer. The tubular member includes the coextensive locking means through which the connecting element passes. The locking means has a passage substantially in line with the tubular member and a chamber having a plurality of socket means adapted to releasably receive the spheres on the connecting element. The chamber is positioned on substantially the same plane as the passage. Weight on the extendable legs forces the connecting element to extend into the chamber wherein the spheres are received in the socket means and retained therein until weight is removed from both of the legs.

BRIEF DESCRIPTION OF THE DRAWINGS

The device according to the present invention will now be described in greater detail with reference to the appended drawings wherein.

DETAILED DESCRIPTION OF THE INVENTION

Figure 1:
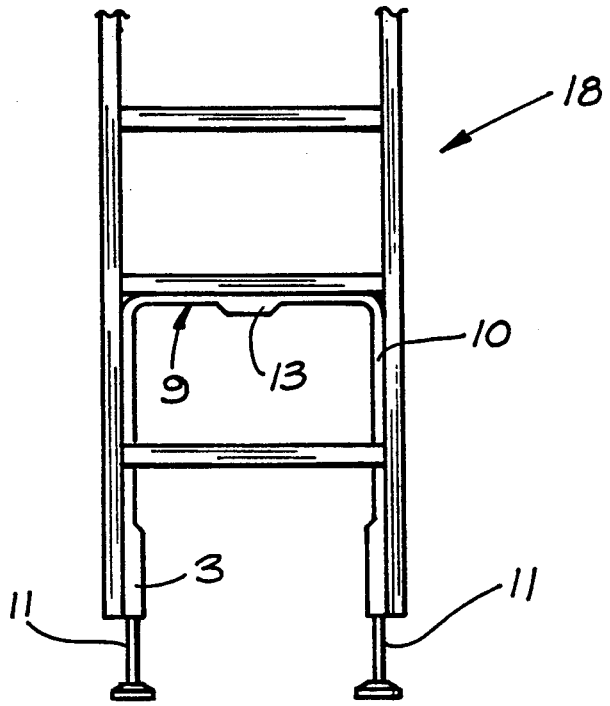
FIG.1 PRIOR ART
FIG. 1 shows the device of Applicant's prior patent.

Referring to FIG. 1, there is shown a ladder 18 to which has been attached the levelling device 9 according to the prior art as disclosed in Applicant's prior U.S. patent. The levelling device comprises U-shaped tubular member 10 having extendable legs 11 reciprocally sliding within the open ends 3 of tubular member 10. The U-shaped tubular member 10 is attached to the ladder by means of clamps (not shown) or such other suitable arrangement known to one skilled in the art.

Figure 2:
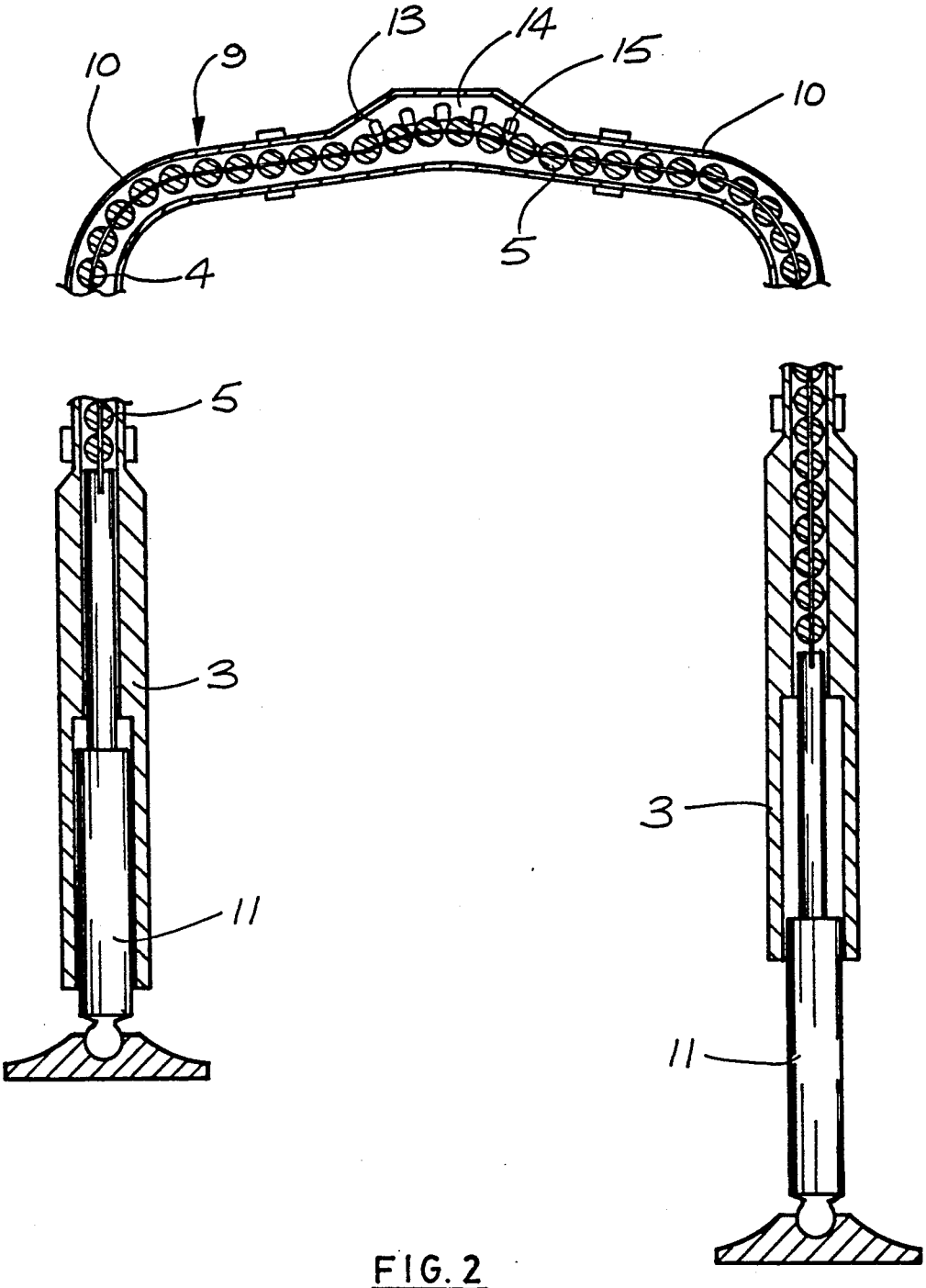
FIG. 2 PRIOR ART
FIG. 2 is an exploded view of the arrangement of Applicant's prior patent.

FIG. 2 shows in greater detail the levelling means of Applicant's prior U.S. patent. The ball chain 4 is shown attached to each of the extendable legs 11 and extending through the tubular member 10 in a continuous fashion. The locking means 13 shown in FIG. 2 includes the arcuate chamber 14 having pins 15 which project downwardly so as to be located between the balls 5 on the ball chain 4. Hence, when weight is applied to the ladder, extendable legs 11 self-adjust until equal force is applied upwardly on the connecting ball chain 4. This causes the chain 4 to be deflected upwardly into the arcuate chamber 14 and the balls 5 are prevented from further longitudinal movement by the pins 15 projecting between the balls 5.

As will be evidenced from FIG. 2, however, if weight is removed from either one of the two legs 11, the ball chain 4 will drop down to the unlocked position thereby permitting the extendable legs 11 to reciprocally move within the tubular member 10 and, as in the example previously described, the ladder would be free to tip over.

Figure 3:
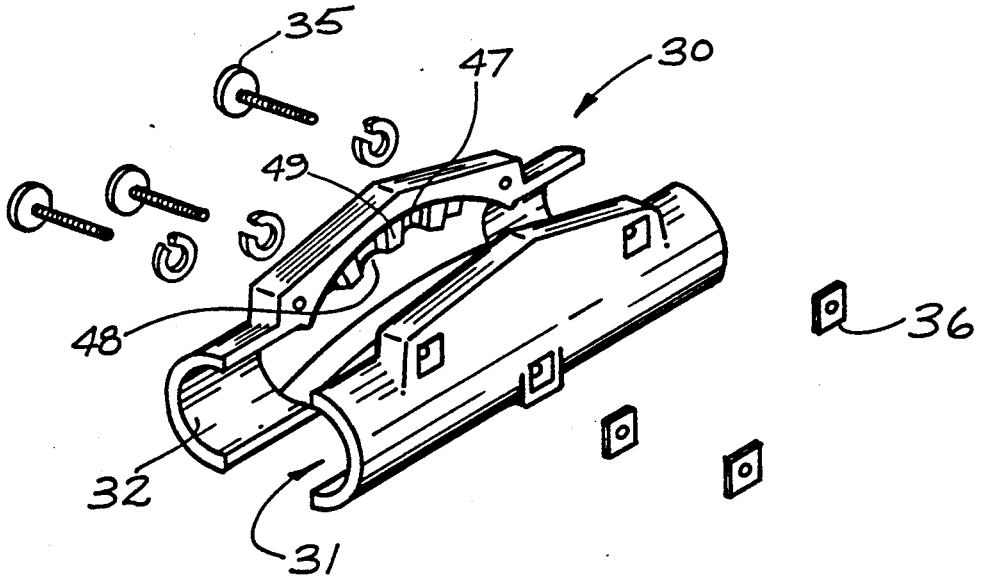
FIG. 3 is an exploded view of the locking device of the present invention.
Figure 4:
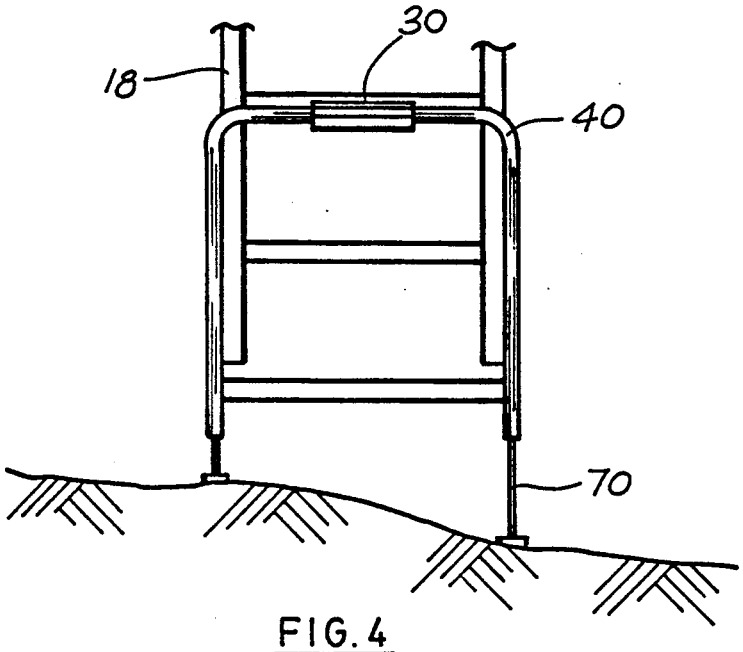
FIG. 4 is a perspective view of the locking device and tubular member installed on a ladder.

The basic structure of Applicant's improved device is similar to the prior art device illustrated in FIGS. 1 and 2. The improvement, however, resides in the locking means 30 which is shown in detail in FIGS. 3 through 6. As indicated in FIG. 3, the locking device includes a central passage 31 which is coextensive with the U-shaped tubular member 40 as best seen in FIG. 4. In accordance with a preferred embodiment of the invention, the locking means 30 includes end sections 32 which are of an appropriate diameter to surround the tubular member 40 and which upon trapping by means of screws 35 and nuts 36 secure the means to the tubular member. As illustrated in FIG. 4, the locking means 30 when installed on the tubular member 40, is positioned so that the chamber 42 is located in the same plane but forward or rearward of the longitudinal axis of the tubular member 40. As best seen in FIG. 3, the chamber has complimentary socket means 47 which, when the device is in its operable position on the tubular member 40, provides a ball receiving surface 48 which surrounds substantially one half of the ball or sphere 50 shown in FIG. 7. The socket means 47 are spaced by islands 49 which are of substantially the same dimension as spacers 52 between the balls or spheres which will be described hereinafter.

Figure 5:
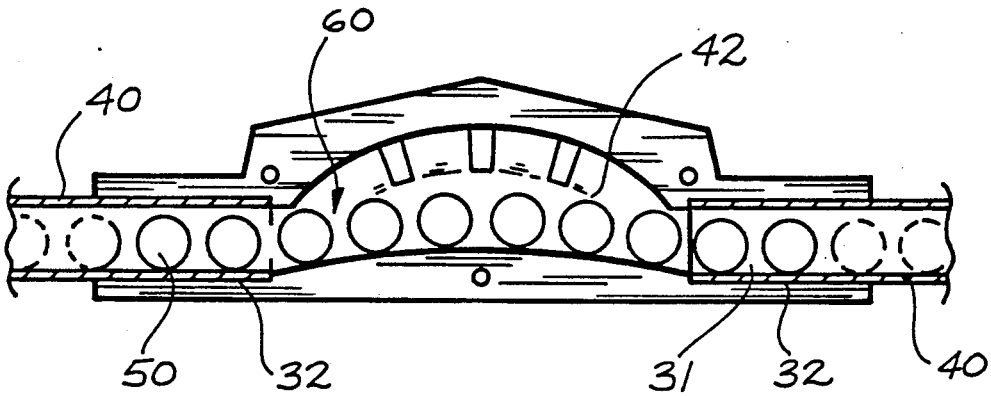
FIG. 5 is a partial view of the ball chain in the locking means in an unlocked mode.
Figure 6:
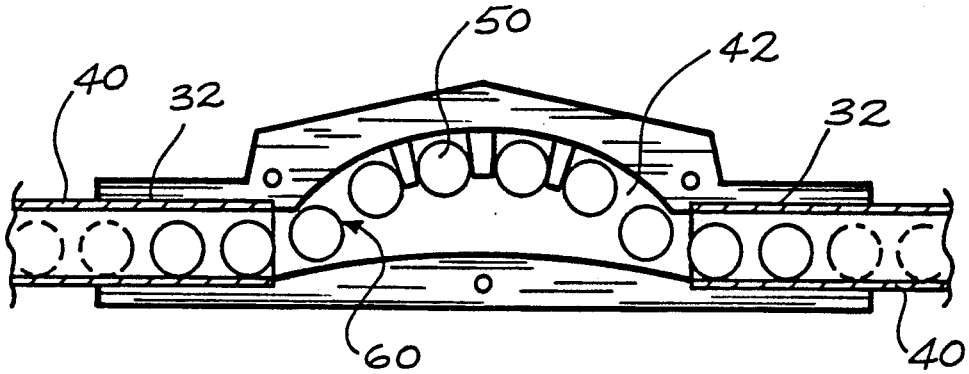
FIG. 6 is a partial view of the locking means showing the ball chain in a locked position.
Figure 7:
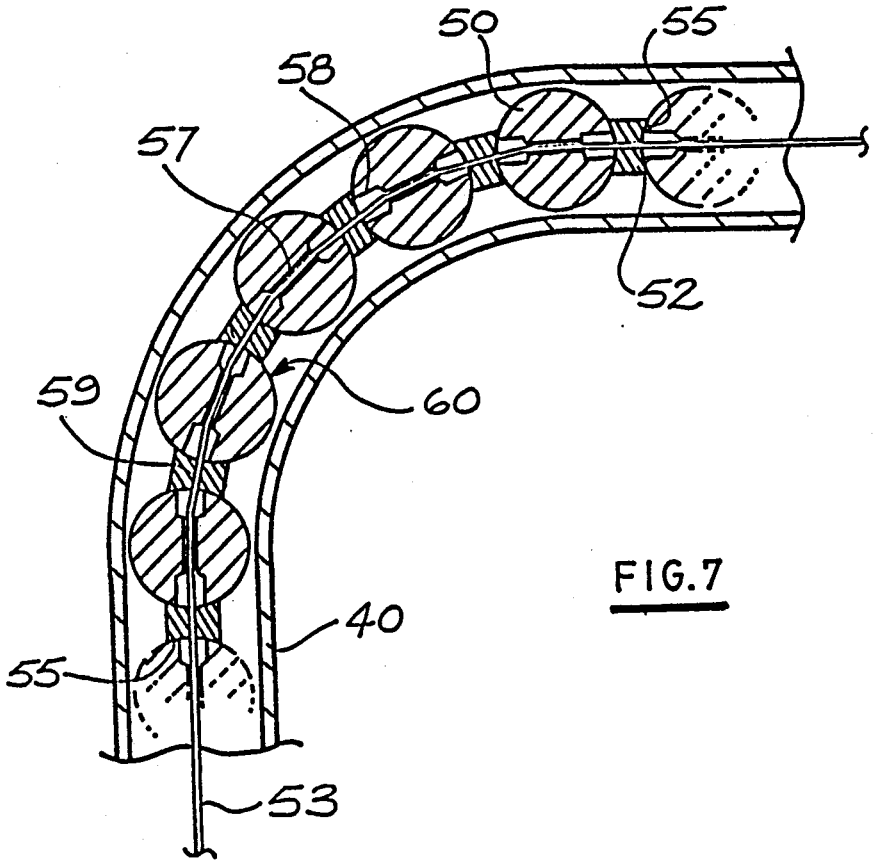
FIG. 7 illustrates the ball chain of the present invention.

FIGS. 5 and 6 illustrate the ball chain 60 in the unlocked and locked modes respectively. For the sake of simplicity, the ball chain 60 is shown with balls or spheres 50 only and without the central core and spacers which are illustrated in FIG. 7. As noted in FIG. 5, the ball chain 60 is in the central passage 31 coextensive with the tubular member 40. In this mode, the ball chain 60 or interconnecting member is free to reciprocally slide longitudinally in the passage 31 and the tubular member 40 so that the slidable or adjustable legs 70 secured to the ball chain in the manner described in U.S. Pat. No. 3,794,141 may self adjust to accommodate an uneven surface.

When the adjustable legs 70 have been positioned so that the ladder is in an upright position and the adjustable legs 70 are positioned so as to accommodate this orientation, downward force on the ladder causes the slidable legs 70 to be forced upwardly which force acts on the connecting element or ball chain 60 and effectively forces the connecting element 60 to be compressed within the tubular member 40. Obviously, this compression force will cause the connecting element 60 to take the path of least resistance which means that the ball chain or connecting element 60 is initially forced upwardly which is the natural direction of force caused by the upward force generated by the legs 70. After the connecting element 60 has moved upwardly to the furthest extent, it will be forced at right angles thereto into the socketed chamber 42. As indicated hereinbefore, the ball or sphere receiving sockets 47 are of an appropriate size to receive and hold the balls or spheres 50 wherein they are positively locked.

In this locked position, if the ladder is tipped so that upward force is removed from one of the legs 70 thereby increasing the force on the opposite leg, the upward force of the opposite leg will act on the spheres 50 of the ball chain 60 to further force it into the sockets 47. The downward force created by the weight of the unsupported free leg will also pull the ball or sphere 50 against the edge of the socket 47 thereby reinforcing the positive locking mechanism. Hence, if someone using the ladder reaches out beyond the safe distance thereby shifting all of the weight on one of the legs so as to lift the other leg off of the supporting surface, the free leg will not be lowered but will remain in the original locked position. Hence, the ladder is much safer to use on uneven ground.

Of course, by simply lifting upward on the ladder after the weight has been removed therefrom, the ball chain 60 will be returned to the position shown in FIG. 5 and the legs will be in the unlocked mode.

The preferred form of the ball chain 60 is illustrated in FIG. 7. In this figure, the ball chain 60 is shown as it traverses one of the rounded corners of the U-shaped member 40. As illustrated in FIG. 7, the balls or spheres 50 are of an appropriate diameter so as to be substantially the same diameter as the bore of the tubular member. The central core 53 which is in the form of a wire and, more particularly, in the form of a stainless steel wire, has sufficient flexibility to allow the connecting member to curve around the corners and to be forced into the chamber in the locking means. The core 53, however, is also such that when weight is removed from both legs 70, the ball chain 60 will quickly snap back to the unlocked position as shown in FIG. 5.

The spacers 52 between the balls 50 are shown in FIG. 7. These spacers 52 have a central bore 59 to allow the core 53 to pass through and have curved end faces 55 of suitable shape to mate with the sphered shape of the balls 50.

It will also be apparent from FIG. 7 that in accordance with a preferred embodiment of the invention, each of the balls 50 has two different diameter bores 57,58. The central bore 57 is of substantially the same diameter of the stainless steel wire core 53. The diameter of both ends of the bore 58, however, is slightly larger as will be apparent from FIG. 7. The central bore 57 ensures that the balls 50 stay in the proper orientation within the tubular member 40. If the bore is too large, the wire core 53 will deflect within the ball 50 which will result in uneven movement of the ball chain 60 or premature rupturing of the core 53. It was found, however, that if the bore at either ends was the same dimension as the core, the spacers 52 would not provide continuous contact with the balls 50 again resulting in uneven movement of the ball chain 60 within the tubular member 40 again resulting in premature rupturing of the core. With the larger diameter bore 58 at either end, the core 53 is able to deflect sufficiently so that the spacers 52 will remain in intimate contact with the balls 50 as the ball chain 60 is forced to curve such as around the curved portion of the tubular member 40 or into the locking chamber 47.

Figure 8A:
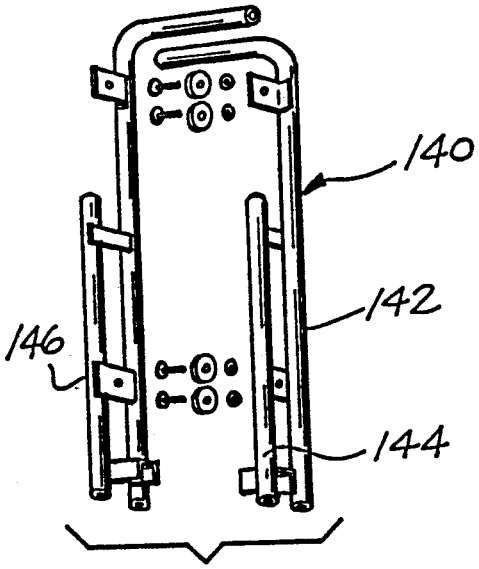
FIG. 8A illustrates the tubular member of a second embodiment.
Figure 8B:
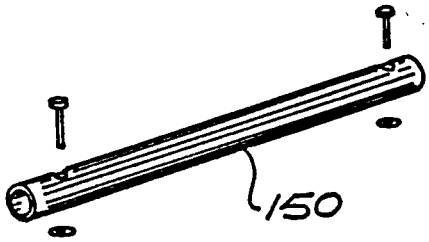
FIG. 8B shows an auxiliary rung for the member of FIG. 8A.
Figure 11:
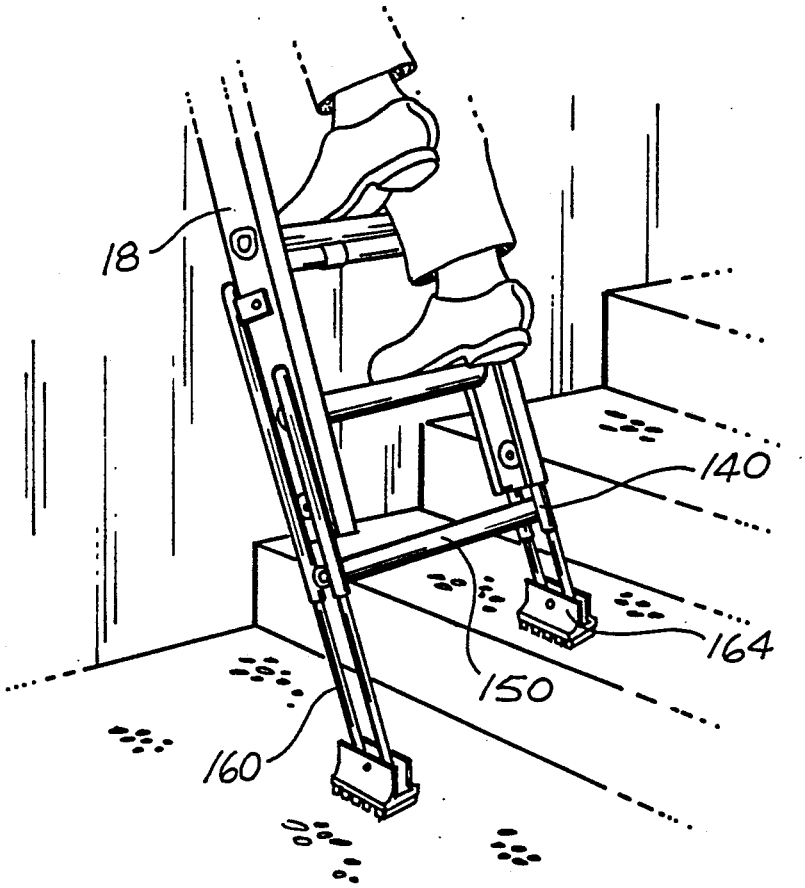
FIG. 11 illustrates the embodiment of FIG. 8 installed on a ladder.

As indicated previously, the tubular member 40 may be a downwardly open U-shaped section as shown in the prior art. There is shown in FIG. 8A a further embodiment of the tubular member 140. It will be noted from FIG. 8A that the member 140 includes in addition to the first tubular member 142, a second tubular member 144 spaced from but parallel to the first member 142. The two tubular members 142,144 are interconnected by web means 146 which may be used to attach the support to a ladder. The webs 146 also, of course, keep the tubular members 142,144 in a fixed relationship one to the other. As shown in FIG. 11, a first rung means 150 seen in FIG. 8B may be interconnected between the free ends of the tubular member 140 so as to provide strength and additional support.

Figure 9:
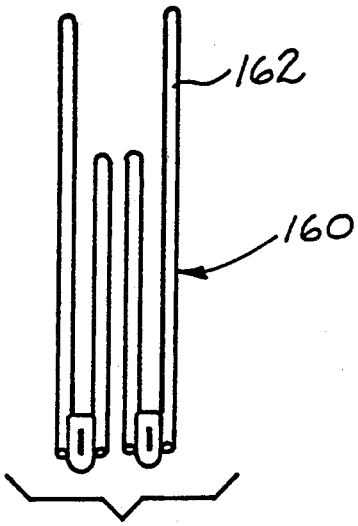
FIG. 9 shows the extension legs used in the embodiment of FIG. 8.

As shown in FIG. 9, an alternate embodiment of the extendable legs 160 are arranged so as to fit into the tubular member 140 of FIG. 8A. The interconnecting ball chain (not shown) is joined to the longer arm 162 of the extendable leg 160.

Figure 10:
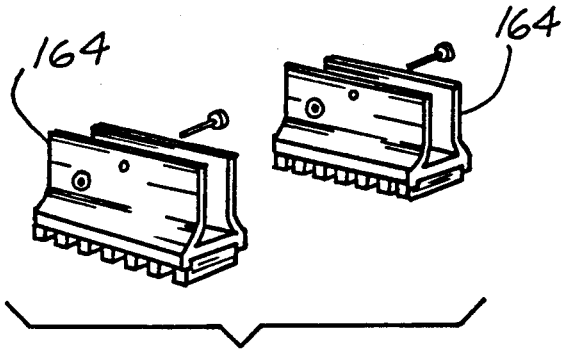
FIG. 10 shows the pivotal feet which may be attached to the legs of FIG. 9.

Preferably, pivotable feet 164 are attached to the lower end of the legs 160 as shown in FIG. 10. Thus, when the leveling device is attached to a ladder and the ladder is positioned beside a vertical surface so that the lower end of the ladder is removed from the vertical wall, the pivotal feet 164 will mean that the entire surface of the feet are resting on the supporting surface. FIG. 11 is an illustration of the ladder levelling device of the second embodiment attached to a ladder and in use on a set of stairs.

Although the foregoing disclosure does not specifically refer to materials and methods of manufacture, it is to be understood that the locking device including the passage and the socket chamber will be constructed of either aluminum or of one of the suitable plastics. As indicated in the disclosure, the central core of the ball chain or connecting element is, in a preferred embodiment, a stainless steel wire whereas the balls or spheres are made of steel or of suitable plastic. Similarly, the spacers located between the balls or spheres are made of steel or suitable plastic. The tubular members are preferably made of coated steel because of its superior strength and resistance to abuse.

From the foregoing description of the preferred embodiment of the invention, it will be apparent to one skilled in the art that various modifications may be made therein. Thus, it is intended in the appended claims to cover all such modifications that fall within the scope of the invention.

I claim:

1. A device for adapting the length of a pair of legs to the unevenness of a surface, said device comprising a pair of vertically reciprocally extendable legs, each extendable leg guidable mounted in a tubular member attached to said pair of legs, said tubular member in the shape of a downwardly open U, a longitudinally slidable chain like connecting element accommodated in said tubular member, said connecting element being connected at its each end to one of said pair of extendable legs, said connecting element comprising a flexible core having thereon a plurality of spheres, each of said spheres separated by a spacer, said tubular member including coextensive locking means through which said connecting element passes, said locking means having a passage substantially in line with said tubular member and a chamber having a plurality of socket means adapted to releasably receive said sphere on said connecting elements, said chamber being positioned on substantially the same place as said passage, whereby weight on said extendable legs forces said connecting element to extend into said chamber wherein said spheres are received in said socket means and retained therein until weight is removed from both of said legs.

2. A device according to claim 1 wherein said chamber has an arcuate wall and said socket members are formed into said wall.

3. A device according to claim 1 wherein said flexible core is a strand of stainless steel wire.

4. A device according to claim 1 wherein said spheres have a bore extending centrally therein through said bore having a mid section of a diameter slightly larger than the diameter of said core and outer sections of larger diameter.

5. A device according to claim 1 wherein said tubular member has a second tubular member parallel to and spaced from said tubular member, said tubular member and said second tubular member being retained in parallel relationship by connecting webs.

6. A device according to claim 5 wherein said connecting webs are provided with means to attach said tubular member to said legs.

7. A device according to claim 5 wherein said extendable legs comprise a pair of leg members adapted to be slidably received in said tubular member and said second tubular member.

8. In an apparatus for adjusting the length of a pair of legs, particularly of a ladder to match irregularities in a supporting surface, said apparatus including two extension legs, each extension leg being guidably mounted in a tubular member attached to said pair of legs, said tubular member being a downwardly open U, a longitudinally slidable chain like element in said tubular member connected at each end to respective ones of said extension legs to provide reciprocable displacement of said extension legs within said tubular member, said chain like element comprising a flexible core having thereon a plurality of spheres of a dimension slightly less than the internal diameter of said tubular member, each of said spheres being separated by a spacer, the improvement comprising locking means on said tubular member, said locking means including a passage substantially coextensive with said tubular member and a chamber having a plurality of socket means adapted to releasably receive said sphere on said connecting elements, said chamber being positioned on substantially the same place as said passage, whereby weight on said extendable legs forces said connecting element to extend into said chamber wherein said spheres are received in said socket means and retained therein until weight is removed from both of said legs.

* * * * *